US009530538B2

(12) United States Patent
Takeuchi et al.

(10) Patent No.: US 9,530,538 B2
(45) Date of Patent: Dec. 27, 2016

(54) WIRE HARNESS MANUFACTURING METHOD AND WIRE HARNESS

(71) Applicant: YAZAKI CORPORATION, Tokyo (JP)

(72) Inventors: Kazuya Takeuchi, Susono (JP); Hiroshi Ichikawa, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/967,564

(22) Filed: Dec. 14, 2015

(65) Prior Publication Data

US 2016/0172075 A1 Jun. 16, 2016

(30) Foreign Application Priority Data

Dec. 15, 2014 (JP) ..... 2014-252806

(51) Int. Cl.
*H01B 7/00* (2006.01)
*H01B 13/012* (2006.01)

(52) U.S. Cl.
CPC ..... *H01B 7/0045* (2013.01); *H01B 13/0129* (2013.01)

(58) Field of Classification Search
CPC ..... H01B 7/0045; H01B 13/01209; H01B 13/01281
USPC ..... 174/72 A
See application file for complete search history.

(56) References Cited

U.S. PATENT DOCUMENTS 7,132,028 B1 * 11/2006 Wahlers-Schmidlin H02G 3/0481 156/184
2015/0053478 A1 2/2015 Kawaguchi et al.

FOREIGN PATENT DOCUMENTS

JP 2013-168322 A 8/2013

* cited by examiner

*Primary Examiner* — Hoa C Nguyen
*Assistant Examiner* — Amol Patel
(74) *Attorney, Agent, or Firm* — Sughrue Mion, PLLC

(57) ABSTRACT

A wire harness includes plural cables, a first sheet and a second sheet. The first sheet includes a base sheet, and a self-adhesive layer formed on a whole of only first surface of the base sheet. The first sheet is wound on the plural cables so that a non-self-adhesive layer formed on a second surface, opposite to the first surface, of the first sheet is located inside. The second sheet includes a base sheet and a self-adhesive layer formed on a whole of only first surface of the base sheet. The second sheet is wound on the first sheet so that the self-adhesive layer of the first surface of the second sheet is located inside.

3 Claims, 5 Drawing Sheets

WIRE HARNESS MANUFACTURING METHOD AND WIRE HARNESS

CROSS REFERENCE TO RELATED APPLICATIONS

This application is based on Japanese Patent Application (No. 2014-252806) filed on Dec. 15, 2014, the contents of which are incorporated herein by reference.

BACKGROUND OF THE INVENTION

1. Field of the Invention

The present invention relates to a wire harness manufacturing method and a wire harness.

2. Description of the Related Art

Recently, a wire harness has been proposed in which plural cables are bundled by a sheet having an adhesive layer (refer to JP-A-2013-168322). In this wire harness, one surface of one end portion has a first self-adhesive layer and the other surface is not adherent. On the other hand, the one surface of the other end portion is not adherent and the other surface has a second self-adhesive layer. The self-adhesive layer is an adhesive layer that adheres to and therefore fixes to another self-adhesive layer and neither adheres nor fixes to a non-self-adhesive layer. Therefore, a worker bundles plural cables by winding such a sheet on them in such a manner that its self-adhesive layers adhere to each other.

However, in the wire harness disclosed in JP-A-2013-168322, the sheet is special in that only part of the one surface and part of the other surface have a self-adhesive layer. Therefore, every time a worker bundles cables, the worker needs to form a sheet by cutting out a portion having a prescribed size from a base sheet by applying a proper material to prescribed portions of both surfaces of the cut-out base sheet portion. This lowers the manufacturing efficiency of wire harnesses.

SUMMARY OF THE INVENTION

The present invention has been made to solve the above problems in the art, and an object of the invention is therefore to provide a wire harness manufacturing method capable of suppressing reduction of the manufacturing efficiency of a wire harness as well as a wire harness that can suppress reduction of its manufacturing efficiency.

The invention provides a manufacturing method of a wire harness in which plural cables are bundled by a sheet having an adhesive layer, the manufacturing method including: a first step of preparing a first sheet and a second sheet, each of which including a base sheet and a self-adhesive layer formed on a whole of only first surface of the base sheet; a second step of forming an intermediate member by winding the first sheet prepared in the first step on the plural cables so that a non-self-adhesive layer formed on a second surface, opposite to the first surface, of the first sheet is located inside; and a third step of winding the second sheet prepared in the first step on the intermediate member formed in the second step so that the self-adhesive layer of the first surface of the second sheet is located inside.

In this manufacturing method of a wire harness, a first sheet and a second sheet in each of which the self-adhesive layer is formed on the whole of only the first surface of the base sheet are prepared in the first step. The base sheets on each of whose first entire surfaces is formed with the self-adhesive layer are common sheets and can be stored in roll form. Therefore, in the first step, the first sheet and the second sheet can be prepared merely by cutting out portions having prescribed sizes form rolls.

In the subsequent steps, the intermediate member is formed by winding the first sheet on plural cables with its non-self-adhesive layer of the second surface located inside and then the second sheet is wound on the intermediate member formed in the second step with the self-adhesive layer of the second sheet located inside. As a result, reduction of the manufacturing efficiency of a wire harness can be suppressed.

In the manufacturing method of a wire harness according to the invention, for example, in the second step, the intermediate member is formed so that the first sheet is wound on the plural cables so as to have an open portion that exposes a part of outer circumferences of the plural cables, and in the third step, the second sheet is wound on the intermediate member so as to cover the open portion of the first sheet.

In this manufacturing method of a wire harness, the second step forms the intermediate member in which the first sheet is wound on the plural cables so as to expose the part of the outer circumferences of the plural cables. If the first sheet is long enough to cover the entire outer circumference of the combination of the plural cables, portions of the first sheet may be caused to adhere to each other so as to form a "joined hands" shape, for example. However, if this is impossible, in the third step the plural cables are bundled together by winding the second sheet on the intermediate member so as to cover the opening portion. In this manner, even if the first sheet is shorter than the outer circumference of the combination of the plural cables, a wire harness can be manufactured properly.

In the manufacturing method of a wire harness according to the invention, for example, the manufacturing method further includes a fourth step of forming a single long sheet by bringing end portions of the self-adhesive layers of the first sheet and the second sheet prepared in the first step to each other, before performing the second step. In the second step, the intermediate member is formed by placing the plural cables on the non-self-adhesive-layer of the first sheet of the long sheet formed in the fourth step, and then the first sheet is wound on the plural cables.

In this manufacturing method of a wire harness, since the fourth step of forming the single long sheet by bringing end portions of the first surfaces of the first sheet and the second sheet into contact with each other (i.e., causing them to adhere to each other) is executed before the first sheet is wound on the plural cables, the work efficiency can be increased. That is, since the long sheet is formed and the plural cables are placed on the non-self-adhesive layer of the first sheet, the open portion can be covered with the second sheet automatically. It is not necessary to wind the second sheet on the first sheet while checking the position of the opening portion. The work efficiency can be increased accordingly.

In the manufacturing method of a wire harness according to the invention, for example, in the second step, the intermediate member is formed by placing the plural cables on the non-self-adhesive layer of the first sheet of the long sheet formed in the fourth step at a position that is located in a region where the first sheet and the second sheet are in contact with each other, and then the first sheet is wound on the plural cables without moving the plural cables. In the third step, the second sheet is wound on the intermediate member without moving the intermediate member.

In this manufacturing method of a wire harness, the plural cables are placed on the non-self-adhesive layer of the first sheet of the long sheet at a position that is located in a region where the first sheet and the second sheet are in contact with each other. An intermediate member is formed by winding the first sheet on the plural cables without moving the plural cables and winding the second sheet on the intermediate member without moving the intermediate member. In this case, the long sheet is not wound on the plural cables in a manner similar to sushi roll making.

For example, the plural cables are separated from each other during a process of bundling them together. Therefore, where a wire harness is manufactured by moving the plural cables in a manner similar to sushi roll making, there may occur an event that the plural cables are separated from each other to form gaps in between in a resulting wire harness, a state that it cannot be said that the plural cables are bundled by the sheet. In contrast, where the above manufacturing method is employed, it is not necessary to move the plural cables in a manner similar to sushi roll making and hence the plural cables can be bundled firmly by the sheet.

The invention also provides a wire harness which includes plural cables, a first sheet and a second sheet. The first sheet includes a base sheet, and a self-adhesive layer formed on a whole of only first surface of the base sheet. The first sheet is wound on the plural cables so that a non-self-adhesive layer formed on a second surface, opposite to the first surface, of the first sheet is located inside. The second sheet includes a base sheet and a self-adhesive layer formed on a whole of only first surface of the base sheet. The second sheet is wound on the first sheet so that the self-adhesive layer of the first surface of the second sheet is located inside.

In this wire harness, the plural cables are bundled using the first sheet and the second sheet in each of which the self-adhesive layer is formed on the whole of only first surface of the base sheet. Therefore, no time and labor to form a special sheet are necessary. This makes it possible to provide a wire harness that can suppress reduction of the manufacturing efficiency.

In the wire harness according to the invention, for example, the first sheet is wound on the plural cables so as to have an open portion that exposes a part of outer circumferences of the plural cables, and the second sheet is wound on the first sheet so as to cover the open portion of the first sheet.

In this wire harness, the first sheet is wound on the plural cables so as to have the open portion that exposes the part of the outer circumferences of the plural cables and the second sheet be wound on the first sheet so as to cover the open portion of the first sheet. If the first sheet is long enough to cover the entire outer circumferences of the plural cables, portions of the first sheet may be caused to adhere to each other so as to form a "joined hands" shape, for example. However, if this is impossible, the plural cables are bundled together by winding the second sheet on the first sheet so as to cover the opening portion. In this manner, even if the first sheet is shorter than the outer circumference of the combination of the plural cables, a wire harness can be provided in which the plural cables are bundled properly.

The invention makes it possible to provide a wire harness manufacturing method capable of suppressing reduction of the manufacturing efficiency of a wire harness as well as a wire harness that can suppress reduction of its manufacturing efficiency.

DETAILED DESCRIPTION OF THE EXEMPLARY EMBODIMENTS

Preferred embodiments of the present invention will be hereinafter described with reference to the drawings. However, the invention is not limited to the following embodiments.

Figure 1:
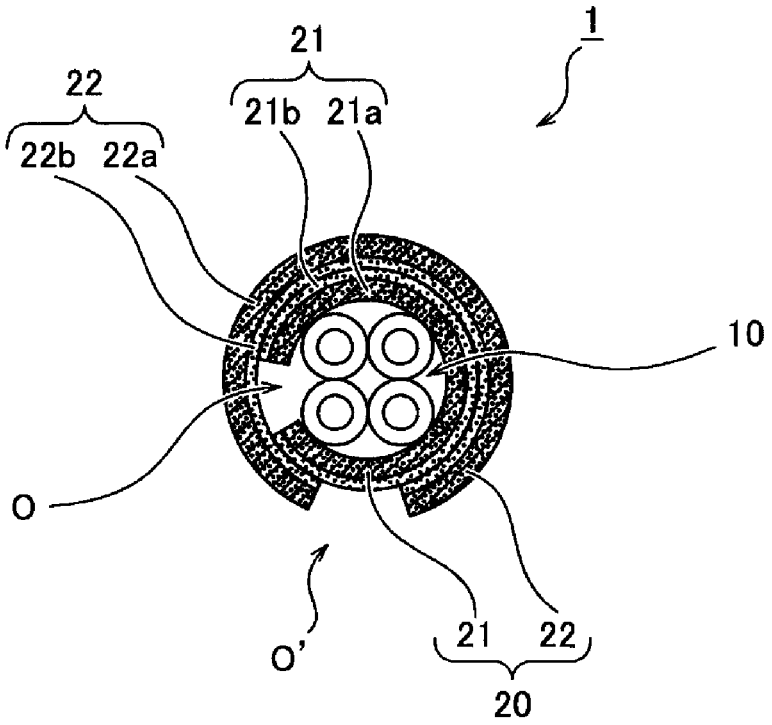
FIG. 1 is a sectional view of a wire harness according to a first embodiment of the present invention.

FIG. 1 is a sectional view of a wire harness 1 according to a first embodiment of the invention. The wire harness 1 shown in FIG. 1 is configured in such a manner that plural cables 10 are bundled by a sheet 20 having adhesive layers.

Figure 2:
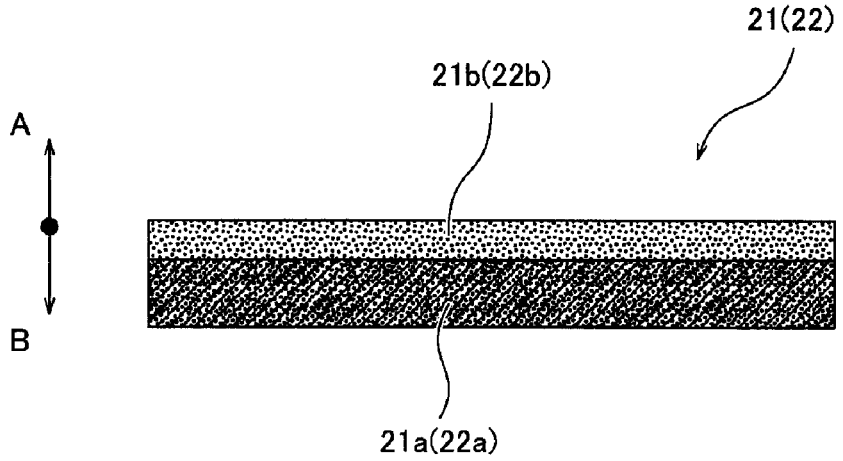
FIG. 2 is a developed sectional view of a first sheet shown in FIG. 1.

Each of the plural cables 10 is composed of at least a conductor and an insulator that surrounds the conductor. The sheet 20 consists of a first sheet 21 and a second sheet 22. FIG. 2 is a developed sectional view of the first sheet 21 shown in FIG. 1. The first sheet 21 has a structure that a self-adhesive layer 21*b* is formed on the whole of only one surface of a base sheet 21*a* having a prescribed size, and hence has a self-adhesive layer side A and a non-self-adhesive-layer side B which is opposite to the former.

Like the first sheet 21, the second sheet 22 has a structure that a self-adhesive layer 22*b* is formed on the whole of only one surface of a base sheet 22*a* having a prescribed size, and hence has a self-adhesive layer side A and a non-self-adhesive-layer side B which is opposite to the former.

Each of the self-adhesive layers 21*b* and 22*b* has such a property as to adhere to and therefore fix to the other and to neither adhere nor fix to a non-self-adhesive layer. The self-adhesive layers 21*b* and 22*b* are made of butyl rubber, for example.

Again referring to FIG. 1, the first sheet 21 is wound on the plural cables 10 with its non-self-adhesive-layer side B located inside. The second sheet 22 is wound on the first sheet 21 with its self-adhesive layer side A located inside.

The first sheet 21 is wound on the plural cables 10 so as to expose part of the outer circumference of the combination of the plural cables 10, to form an open portion O. The second sheet 22 is wound on the first sheet 21 so as to cover the open portion O.

As described above, in the wire harness 1 according to the first embodiment, the plural cables 10 are bundled using the first sheet 21 and the second sheet 22 in each of which the self-adhesive layer 21*b* or 22*b* is formed on the whole of only one surface of the base sheet 21*a* or 22*b*. Therefore, no time and labor to form a special sheet as used in the wire harness disclosed in JP-A-2013-168322 are necessary.

Figure 3:
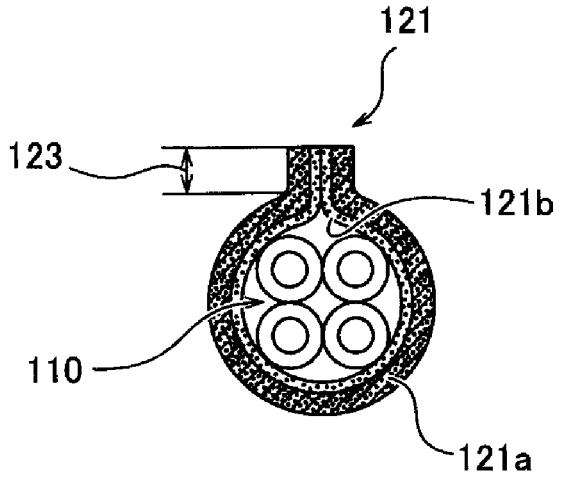
FIG. 3 is a sectional view of a wire harness of a referential example.

Furthermore, since the second sheet 22 is wound on the first sheet 21 so as to cover the opening portion O, the plural cables 10 can be bundled properly. FIG. 3 is a sectional view of a wire harness of a referential example. In this example, plural cables 110 are bundled without forming an open portion O. And a first sheet 121 is required to be longer than the outer circumference of the combination of the plural cables 110. In this example, the plural cables 110 can be bundled by the first sheet 121 by winding it with its self-adhesive layer 121*b* located inside and causing the portions of the self-adhesive layer 121*b* that are formed in a projection portion (excess portion) 123 to adhere to each other in a "joined hands" shape.

On the other hand, in the first embodiment, since the first sheet 21 is shorter than the outer circumference of the combination of the plural cables 10, the first sheet 21 is wound on the plural cables 10 so as to form the open portion O; portions of the first sheet 21 cannot adhere to each other so as to form a "joined hands" shape. Although the first sheet 21 is shorter than the outer circumference of the combination of the plural cables 10, the wire harness 1 in which the plural cables 10 are bundled properly can be provided by winding the second sheet 22 on the first sheet 21 so as to cover the opening portion O.

Figure 4A:
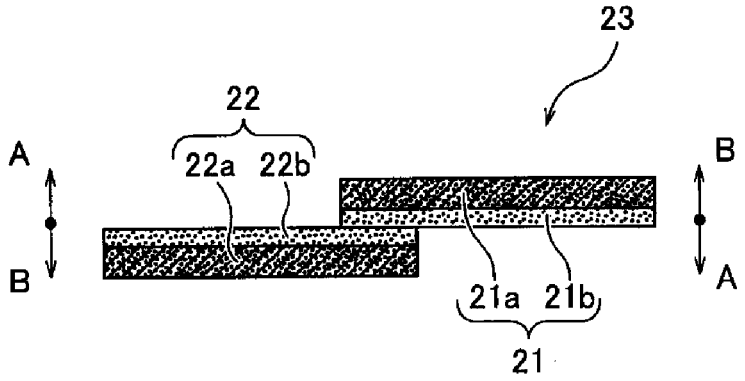
FIGS. 4A-4C are sectional views showing a fourth step, a second step, and a third step, respectively, of a manufacturing method of the wire harness shown in FIG. 1.
Figure 4B:
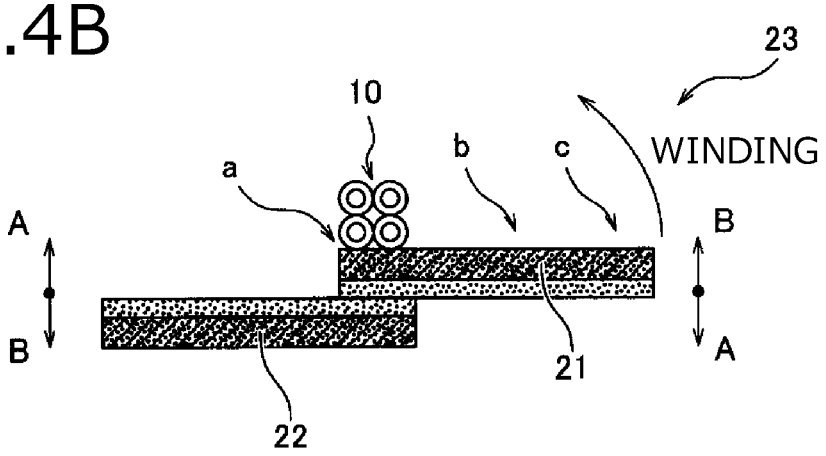
Figure 4C:
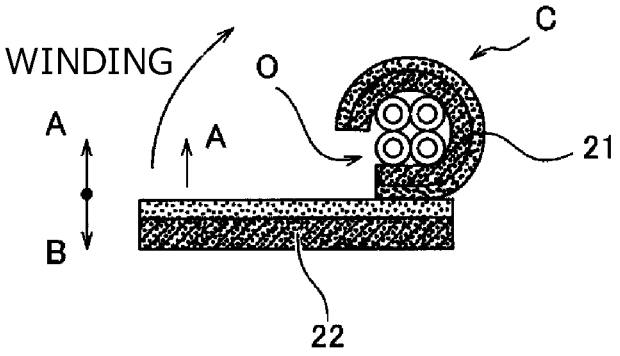

Next, a manufacturing method of the wire harness 1 according to the first embodiment will be described. FIGS. 4A-4C are sectional views showing a fourth step, a second step, and a third step, respectively, of the manufacturing method of the wire harness 1 shown in FIG. 1. The manufacturing method of the wire harness 1 is performed in order of a first step, the fourth step, the second step, and the third step.

First, in the first step, a first sheet 21 and a second sheet 22 as described above are prepared. The first sheet 21 and the second sheet 22 are prepared by cutting out portions having prescribed sizes from a rolled sheet. In the embodiment, since it is not necessary to cause portions of the first sheet 21 cannot adhere to each other so as to form a "joined hands" shape, the sizes of the cut-out first sheet 21 and second sheet 22 may be set roughly, that is, need not be set as to be suitable for the number of plural cables 10. The first sheet 21 and the second sheet 22 may be cut out intentionally so as to be shorter than lengths at which intended circles are just formed, respectively. This is because if a projection portion (joined-hands-like portion) (123) is formed, it tends to be obstructive, for example, lower the ease of routing.

Then, as shown in FIG. 4A, in the fourth step, end portions of the one surfaces (surfaces of the self-adhesive layer side A) of the first sheet 21 and the second sheet 22 are brought into contact with each other to form a single long sheet 23.

Then, as shown in FIG. 4B, in the second step, plural cables 10 are placed on the other surface of the first sheet 21 of the long sheet 23 formed in the fourth step. The plural cables 10 may be placed on the first sheet 21 at the position a of contact between the first sheet 21 and the second sheet 22, a halfway position b of the first sheet 21, or the other end position c of the first sheet 21.

Furthermore, in the second step, the first sheet 21 is wound on the plural cables 10 which are placed at the position a, b, or c, with the non-self-adhesive-layer side B of the first sheet 21 located inside. Thus, an intermediate member C is formed.

If the first sheet 21 was cut out at the first step so as to be shorter than the length at which the intended circle is just formed, as shown in FIG. 4C the intermediate member C is formed in such a manner that the first sheet 21 is wound on the plural cables 10 so as to expose part of the outer circumference of the combination of the plural cables 10.

Subsequently, as shown in FIG. 4C, in the third step, the second sheet 22 is wound on the intermediate member C with its self-adhesive layer side A located inside. At this time, the second sheet 22 is wound on the intermediate member C so as to cover the open portion C. The manufacture of the wire harness 1 shown in FIG. 1 is thus completed.

Although it is stated above that in the second step the plural cables 10 may be placed at any of the positions a-c, it is preferable that they be placed at the position a. Where the plural cables 10 are placed at the position b or c, the long sheet 23 is wound on them in a manner similar to sushi roll making. In this case, the plural cables 10 themselves are moved, they may be separated from each other to form gaps between them in a resulting wire harness 1. The plural cables 10 may even be rendered in a state that it cannot be said that they are bundled together.

On the other hand, where plural cables 10 are placed at the position a, it is not necessary to move them in a manner similar to sushi roll making. That is, the first sheet 21 and the second sheet 22 can be wound on the plural cables 10 without moving the plural cables 10, as a result of which the plural cables 10 can be bundled by the sheet 20.

As described above, in the manufacturing method of the wire harness 1 according to the first embodiment, a first sheet 21 and a second sheet 22 in each of which a self-adhesive layer 21*b* or 22*b* is formed on the whole of only one surface of the base sheet 21*a* or 22*b* having a prescribed size are prepared in the first step. The base sheets 21*a* and 22*b* on each of whose one entire surfaces is formed with the self-adhesive layer 21*b* or 22*b* are common sheets and can be stored in roll form. Therefore, in the first step, a first sheet 21 and a second sheet 22 can be prepared merely by cutting out portions having prescribed sizes form rolls.

In the subsequent steps, an intermediate member C is formed by winding the first sheet 21 on plural cables 10 with its non-self-adhesive-layer side B located inside and then the second sheet 22 is wound on the intermediate member C formed in the second step with the self-adhesive layer side A of the second sheet 22 located inside. As a result, reduction of the manufacturing efficiency of a wire harness can be suppressed.

In the second step, an intermediate member C is formed in which the first sheet 21 is wound on the plural cables 10 so as to expose part of the outer circumference of the combination of the plural cables 10. If the first sheet 21 is long enough to cover the entire outer circumference of the combination of the plural cables 10, portions of the first sheet 21 may be caused to adhere to each other so as to form a "joined hands" shape, for example. However, if this is impossible, in the third step the plural cables 10 are bundled together by winding the second sheet 22 on the intermediate member C so as to cover the opening portion O. In this manner, even if the first sheet 21 is shorter than the outer circumference of the combination of the plural cables 10, a wire harness 1 can be manufactured properly.

Since the fourth step of forming a single long sheet 23 by bringing end portions of the one surfaces of the first sheet 21 and the second sheet 22 into contact with each other (i.e., causing them to adhere to each other) is executed before the first sheet 21 is wound on the plural cables 10, the work efficiency can be increased. That is, since the long sheet 23 is formed and the plural cables 10 are placed on the non-self-adhesive-layer side B of the first sheet 21, the open portion O can be covered with the second sheet 22 automatically. It is not necessary to wind the second sheet 22 on the first sheet 21 while checking the position of the opening portion O. The work efficiency can be increased accordingly.

The plural cables 10 are placed on the portion, where the first sheet 21 and the second sheet 22 are in contact with each other, of the long sheet 23 (i.e., on the non-self-adhesive-layer side B of the first sheet 21) at the position a. An intermediate member C is formed by winding the first sheet 21 on the plural cables 10 without moving the plural cables 10 and winding the second sheet 22 on the intermediate member C without moving the intermediate member C. In this case, the long sheet 23 is not wound on the plural cables 10 in a manner similar to sushi roll making.

It is probable that the plural cables 10 are separated from each other during a process of bundling them together. Therefore, where a wire harness 1 is manufactured by moving the plural cables 10 in a manner similar to sushi roll making, there may occur an event that the plural cables 10 are separated from each other to form gaps in between in a resulting wire harness 1, a state that it cannot be said that the plural cables 10 are bundled by the sheet 20. In contrast, where the manufacturing method according to the embodiment is employed, it is not necessary to move the plural cables 10 in a manner similar to sushi roll making and hence the plural cables 10 can be bundled firmly by the sheet 20.

In the wire harness 1 according to the embodiment, the plural cables 10 are bundled using the first sheet 21 and the second sheet 22 in each of which the self-adhesive layer 21*b* or 22*b* is formed on the whole of only one surface of the base sheet 21*a* or 22*a*. Therefore, no time and labor to form a special sheet as used in the wire harness disclosed in JP-A-2013-168322 are necessary. Thus, the wire harness 1 can be provided which can suppress reduction of its manufacturing efficiency.

Furthermore, the first sheet 21 is wound on the plural cables 10 so as to expose part of the outer circumference of the combination of the plural cables 10 and the second sheet 22 is wound on the first sheet 21 so as to cover the opening portion O. If the first sheet 21 is long enough to cover the entire outer circumference of the combination of the plural cables 10, portions of the first sheet 21 may be caused to adhere to each other so as to form a "joined hands" shape, for example. However, if this is impossible, the plural cables 10 are bundled together by winding the second sheet 22 on the intermediate member C so as to cover the opening portion O. In this manner, even if the first sheet 21 is shorter than the outer circumference of the combination of the plural cables 10, a wire harness 1 can be provided in which the plural cables 10 are bundled properly.

Next, a wire harness 2 according to a second embodiment of the invention will be described, which is similar to the wire harness 1 according to the first embodiment except and partly different from the latter in configuration and manufacturing method. Only differences from the first embodiment will be described below.

Figure 5:
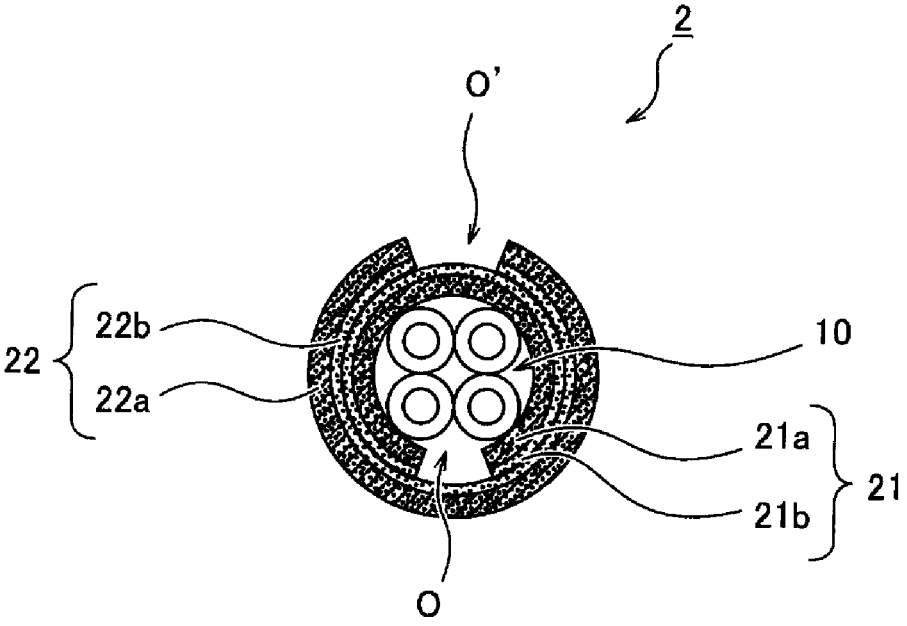
FIG. 5 is a sectional view of the wire harness according to a second embodiment of the invention.

FIG. 5 is a sectional view of the wire harness 2 according to the second embodiment. Unlike in the manufacturing method of the first embodiment shown in FIG. 4, the wire harness 2 according to the second embodiment is manufactured without forming a long sheet 23.

The manufacturing method of the wire harness 1 according to the first embodiment shown in FIG. 1 includes formation of a long sheet 23, as a result of which an open portion O of the first sheet 21 is formed at a position that is relatively close to an open portion O' of the second sheet 22.

In contrast, in the wire harness 2 according to the second embodiment, since no long sheet 23 is formed, the open portion O of the first sheet 21 and the open portion O' of the second sheet 22 do not have such a positional relationship; they can be formed at right opposite positions (i.e., at positions that are deviated from each other by 180°). As a result, the configuration of the wire harness 2 is superior in, for example, preventing entrance of foreign matter (including liquid) into the inside of the first sheet 21.

Figure 6A:
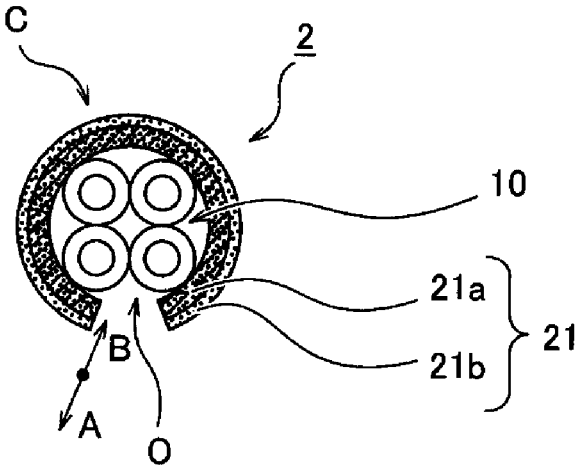
FIGS. 6A and 6B are sectional views showing a second step and a third step, respectively, of a manufacturing method of the wire harness shown in FIG. 5.
Figure 6B:
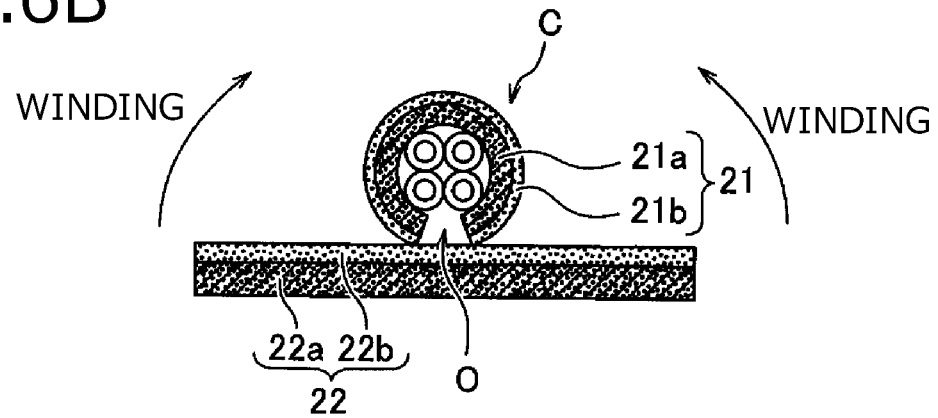

FIGS. 6A and 6B are sectional views showing a second step, and a third step, respectively, of a manufacturing method of the wire harness 2 shown in FIG. 5. The manufacturing method of the wire harness 2 is performed in order of a first step, the second step, and the third step.

First, in the first step, a first sheet 21 and a second sheet 22 as described above are prepared.

Then a transition is made to the second step without execution of the fourth step. In the second step, the first sheet 21 is wound on plural cables 10 with the non-self-adhesive-layer side B of the first sheet 21 (prepared in the first step) located inside. Thus, an intermediate member C is formed.

If the first sheet 21 was cut out at the first step so as to be shorter than the length at which the intended circle is just formed, as shown in FIG. 6A the intermediate member C is formed in such a manner that the first sheet 21 is wound on the plural cables 10 so as to expose part of the outer circumference of the combination of the plural cables 10.

Subsequently, in the third step, the second sheet 22 prepared in the first step is wound on the intermediate member C with its self-adhesive layer side A located inside. At this time, as shown in FIG. 6B, the second sheet 22 is wound on the intermediate member C in such a manner that an open portion C' is formed at a position that is deviated from the open portion O of the first sheet 21 by 180°. The manufacture of the wire harness 2 shown in FIG. 5 is thus completed.

As is understood from the above description, as in the first embodiment, the wire harness manufacturing method and the wire harness 2 according to the second embodiment can suppress reduction of the manufacturing efficiency of a wire harness. Even if the first sheet 21 is shorter than the outer circumference of the combination of the plural cables 10, the wire harness 2 can be manufactured properly.

Furthermore, in the wire harness manufacturing method and the wire harness 2 according to the second embodiment, the open portion O of the first sheet 21 and the open portion O' of the second sheet 22 are formed at positions that are deviated from each other by 180°. Therefore, the wire harness 2 can be provided which is superior in preventing entrance of foreign matter (including liquid) into the inside of the first sheet 21.

Although the invention has been described above using the embodiments, the invention is not limited to those embodiments. The embodiments may be modified or, if possible, combined together without departing from the spirit and scope of the invention.

For example, although in the wire harnesses 1 and 2 according to the embodiments the sheet 20 consists of the two sheets, that is, the first sheet 21 and the second sheet 22, it may additionally be equipped with a third sheet (and other sheets).

What is claimed is:

1. A manufacturing method of a wire harness in which plural cables are bundled by a sheet having an adhesive layer, the manufacturing method comprising:

a first step of preparing a first sheet and a second sheet, each of which comprising a base sheet and a self-adhesive layer formed on a whole of only first surface of the base sheet;

a second step of forming a single long sheet by bringing end portions of the self-adhesive layers of the first sheet and the second sheet to each other;

a third step of placing the plural cables on a non-self-adhesive-layer of the first sheet of the long sheet at a position that is located in a region where the first sheet and the second sheet are in contact with each other;

a fourth step of forming an intermediate member by winding the first sheet on the plural cables so that a non-self-adhesive layer formed on a second surface, opposite to the first surface, of the first sheet is located inside; and a fifth step of winding the second sheet on the intermediate member so that the self-adhesive layer of the first surface of the second sheet is located inside.

2. The manufacturing method according to claim 1, wherein in the fourth step, the intermediate member is formed so that the first sheet is wound on the plural cables so as to have an open portion that exposes a part of outer circumferences of the plural cables; and wherein in the fifth step, the second sheet is wound on the intermediate member so as to cover the open portion of the first sheet.

3. The manufacturing method according to claim 1, wherein the first sheet is wound on the plural cables in the fourth step in a first direction, and the second sheet is wound on the intermediate member in the fifth step in a second direction opposite of the first direction.

* * * * *